US006923738B1

(12) United States Patent
Fulp

(10) Patent No.: US 6,923,738 B1
(45) Date of Patent: Aug. 2, 2005

(54) PRACTICE BAT AND METHOD

(76) Inventor: Christopher L. Fulp, 7370 Plunkett Rd., Belews Creek, NC (US) 27004

( * ) Notice: Subject to any disclaimer, the term of this patent is extended or adjusted under 35 U.S.C. 154(b) by 0 days.

(21) Appl. No.: 10/793,063

(22) Filed: Mar. 4, 2004

(51) Int. Cl.[7] ..... A63B 69/00
(52) U.S. Cl. ..... 473/457; 473/564; 124/5
(58) Field of Search ..... 473/457, 220, 473/221, 223, 451, 453, 564–568, 105, 168, 473/FOR 102, 169, 422; 124/5

(56) References Cited

U.S. PATENT DOCUMENTS 1,530,573 A * 3/1925 Olcott ..... 473/513
2,465,124 A * 3/1949 Quattrin ..... 473/235
3,111,314 A * 11/1963 Topper ..... 473/457
3,115,342 A * 12/1963 Webster ..... 473/457
3,120,387 A 2/1964 Weinstein
3,236,521 A 2/1966 Knott
3,496,924 A * 2/1970 Miller ..... 124/5
3,819,179 A * 6/1974 Ambler et al. ..... 473/457
4,521,015 A * 6/1985 Carafeno ..... 473/457
D427,880 S * 7/2000 Sombatjirakal ..... D8/331
D429,456 S * 8/2000 Chen ..... D8/331

* cited by examiner

*Primary Examiner*—Sebastiano Passaniti
*Assistant Examiner*—M. Chambers

(57) ABSTRACT

A practice bat is provided for baseball or other similar sports which includes an interior longitudinal channel. The channel includes an entrance on the surface of the ball contact section. A 45° guide within the channel directs the ball through the channel where it then passes through an egress. The ball can then strike a batting cage, netting or other suitable ball-stop as provided. A player can greatly increase his hitting skills by learning to hit a ball at a precise location along the impact section of the practice bat.

12 Claims, 4 Drawing Sheets

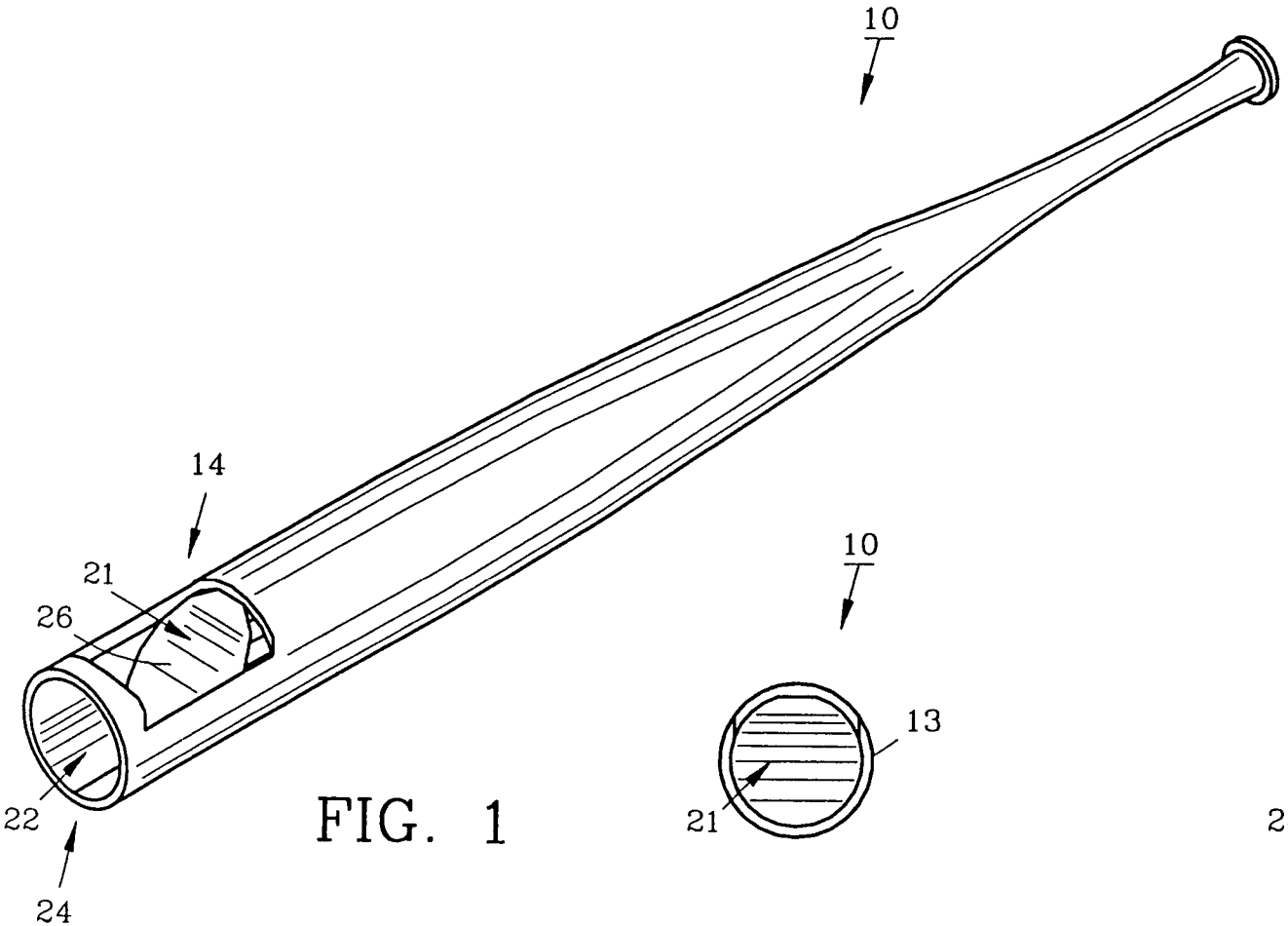
FIG. 1
FIG. 5
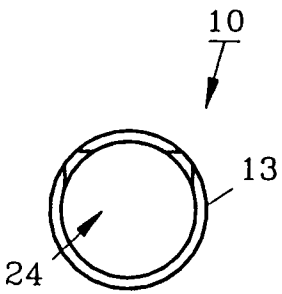
FIG. 6

PRACTICE BAT AND METHOD

FIELD OF THE INVENTION

The invention herein pertains to a bat for striking a ball and particularly pertains to a bat for use during batting practice as for baseball and other similar sports.

DESCRIPTION OF THE PRIOR ART AND OBJECTIVES OF THE INVENTION

Baseball has become an increasingly popular spectator sport in recent years with outstanding players compensated with multi-year contracts and generous salaries. Due in part to the increased "professionalism" of baseball, many young players seek to join major league teams by increasing their skills. One skill in particular which is of ultimate importance is hitting.

With emphasis on transforming players with weak hitting skills into professional quality hitters, many training aids and devices have been created. These include "corked" bats, "weighted" bats, and many other devices. One problem with most training bats is when the ball is struck it often travels a great distance requiring players to spend and waste time hunting and searching for hit balls. Also, most practice bats will not allow the user to determine at which particular point on the bat struck the ball.

Thus, with the problems and disadvantages of conventional training bats and aids the present invention was conceived and one of its objectives is to provide a practice bat which will allow a batter to learn to precisely strike a ball.

It is another objective of the present invention to provide a practice bat and method which will enable the user to immediately identify when he has struck the ball at a desired point on the bat.

It is still another objective of the present invention to provide a practice bat which will eliminate the need of undue hunting and collection of the struck balls during batting practice.

It is also another objective of the present invention to provide a practice bat having an interior channel which will allow balls to pass therethrough.

It is yet another objective of the present invention to provide a method of hitting a ball whereby the bat, when properly swung at the ball allows the ball to pass through an entrance, strike a guide, be directed through a longitudinal channel and to exit the bat at an angle to the ball's delivered direction.

Various other objectives and advantages of the present invention will become apparent to those skilled in the art as a more detailed description is set forth below.

SUMMARY OF THE INVENTION

The aforesaid and other objectives are realized by providing a practice bat for training a hitter which will allow the user to sharpen his hitting skills. The practice bat includes a handle, shank and ball contact section with the ball contact section defining an entrance along its outer surface. A guide is positioned at approximately a 45° angle to the longitudinal axis of the bat. As the ball strikes the guide it changes direction and travels through a short longitudinal channel and then through the egress at the end of the bat. A conventional batting cage, netting or other type of ball-stop can be used to confine the ball as it exits the practice bat. Such ball-stops severely limit the speed of the ball and make collection of the balls much easier and quicker than balls struck with conventional bats. The method of use allows the batter to spend much more time swinging at practice balls and less time in the hunting and collection process.

BRIEF DESCRIPTION OF THE DRAWINGS

FIG. 1 shows a perspective view of the preferred form of the practice bat of the invention;

FIG. 5 pictures a view of the practice bat along lines 5—5 of FIG. 4;

FIG. 6 features a view of the practice bat of FIG. 4 along lines 6—6;

DETAILED DESCRIPTION OF THE PREFERRED EMBODIMENT AND OPERATION OF THE INVENTION

Figure 4:
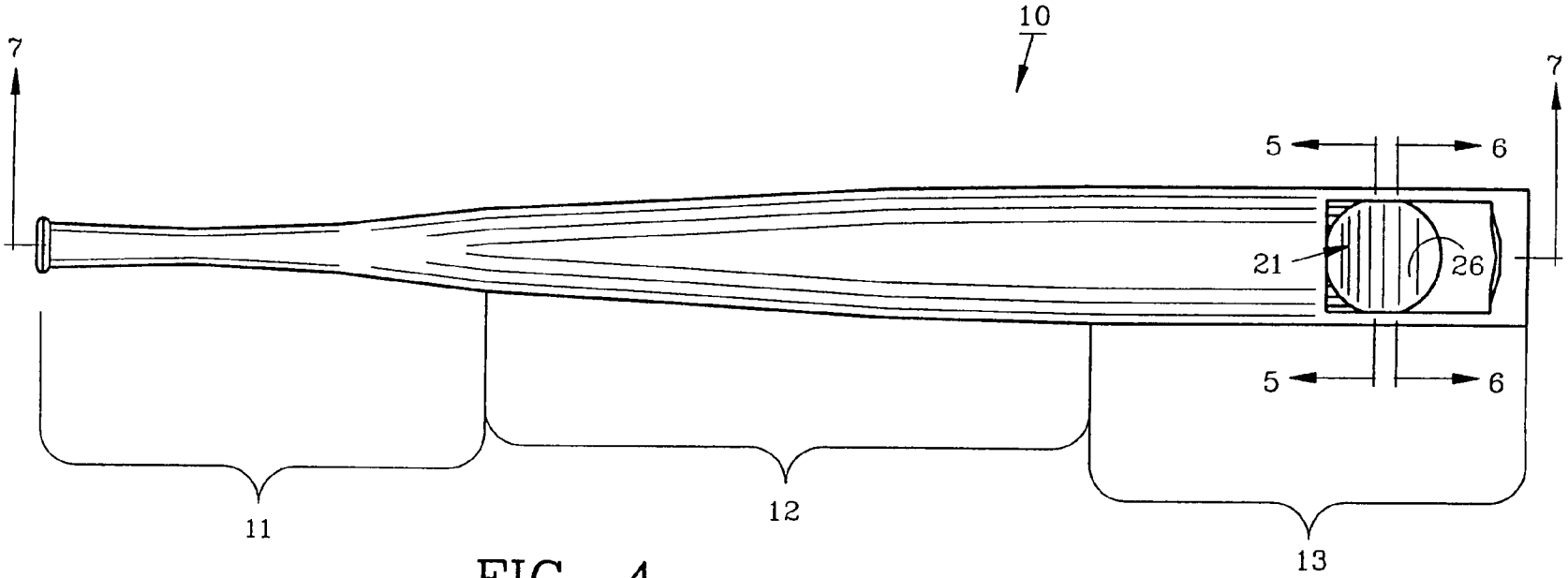
FIG. 4 depicts a top view of the practice bat of FIG. 3.
Figure 8:
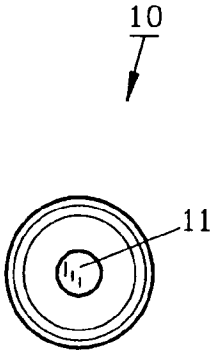
FIG. 8 demonstrates an end view of the practice bat as along lines 8—8 of FIG. 3.

For a better understanding of the invention and its method of use, turning now to the drawings, FIG. 1 shows preferred practice bat 10 which is shaped somewhat similarly to a conventional baseball bat along its handle (FIG. 4) generally shown as 11 and its shank generally shown as 12. FIG. 8 shows an end view of handle 11 as along lines 8—8 of FIG. 3. As seen in FIG. 4, ball contact section 13 is substantially different in that it defines entrance 14, longitudinal channel 22 and egress 24, all in fluid communication. Practice bat 10 is preferably formed of aluminum although other materials may be utilized such as plastic, metal or the like.

Figure 2:
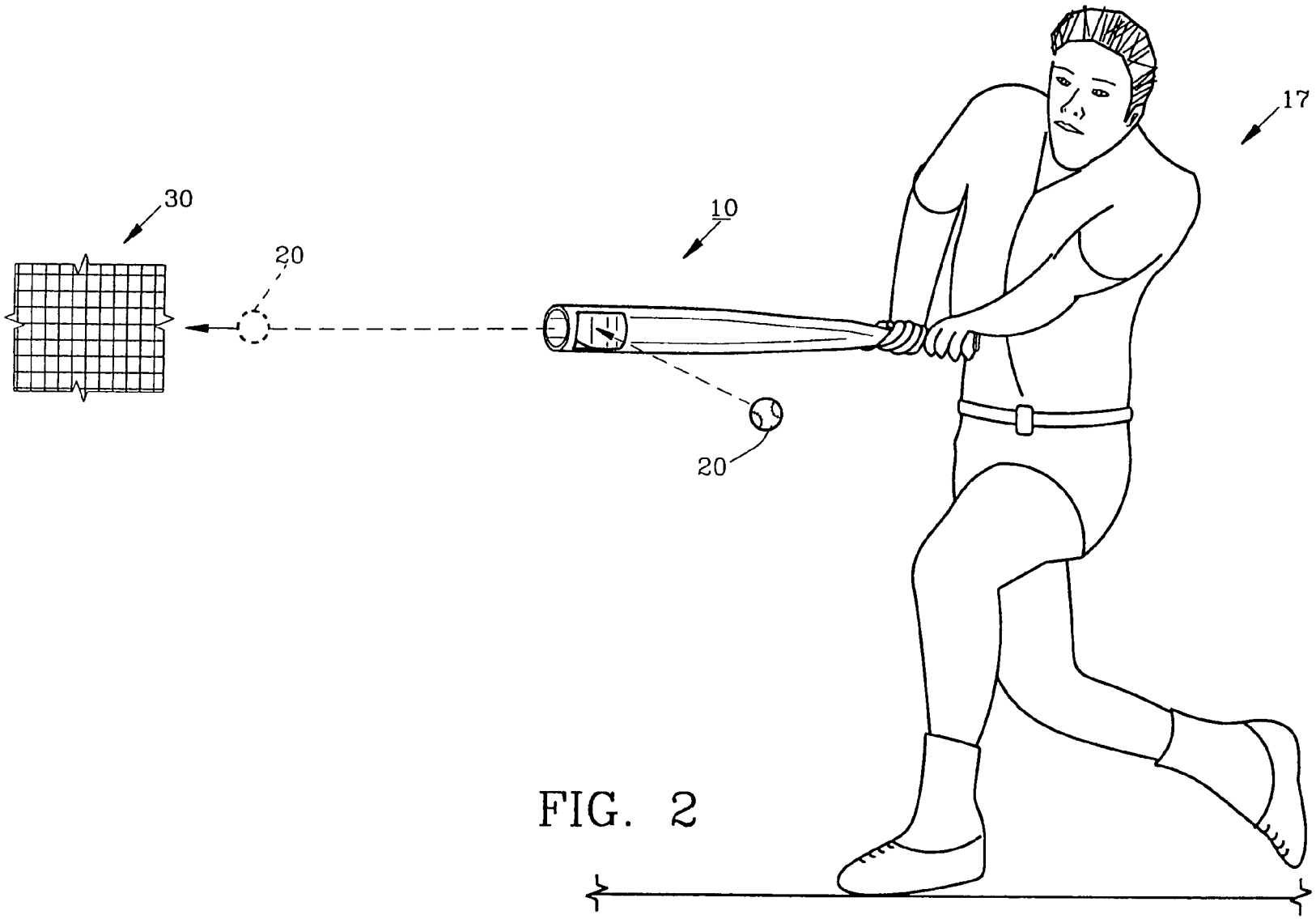
FIG. 2 demonstrates a player using the practice bat seen in FIG. 1.
Figure 3:
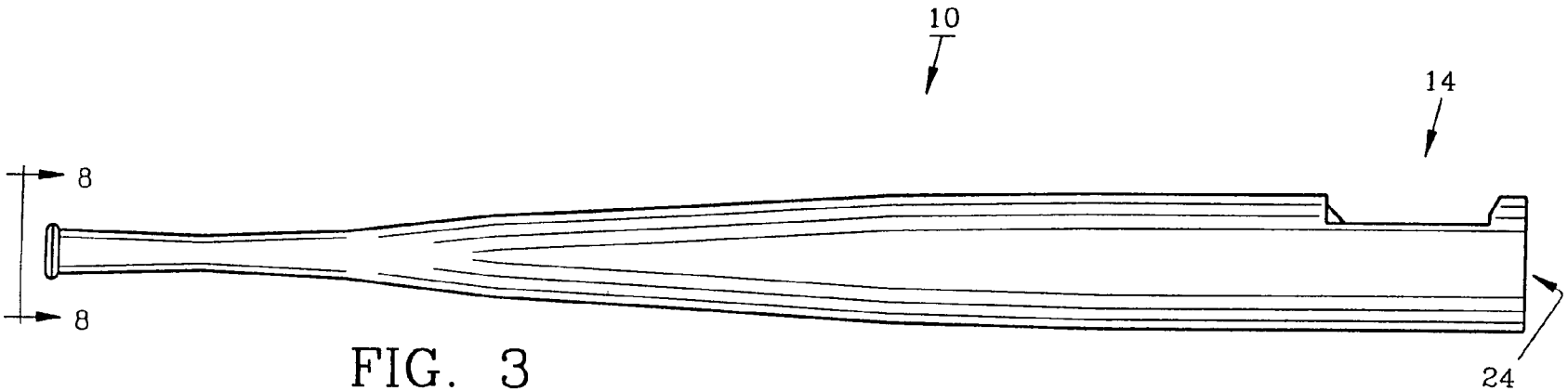
FIG. 3 illustrates a side view of the practice bat shown in FIG. 1.
Figure 7:
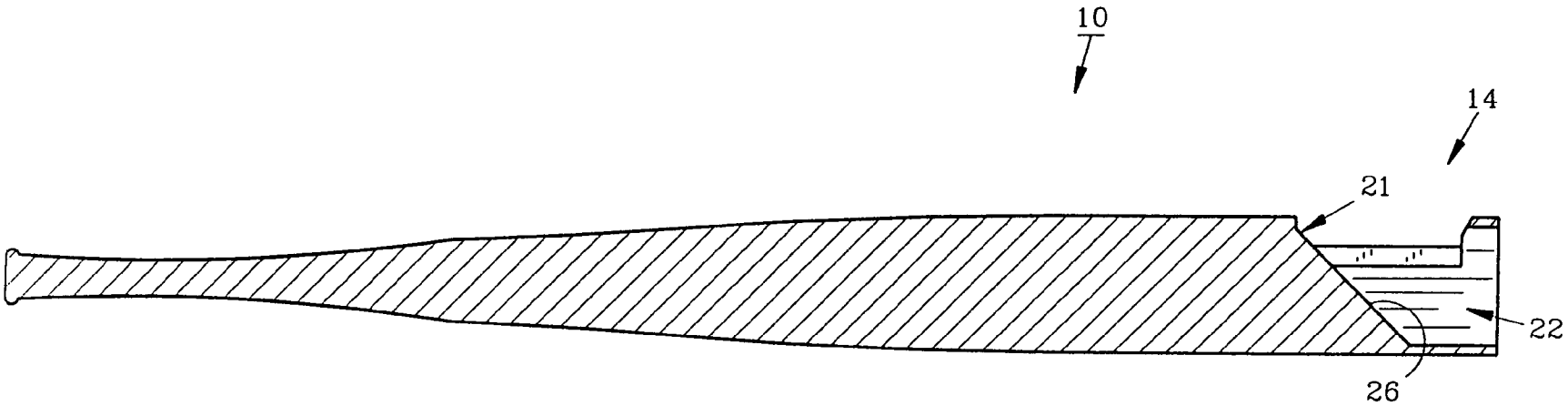
FIG. 7 shows a cross-sectional view of the practice bat along lines 7—7 of FIG. 4.

Ball contact section 13 allows user 17 shown in FIG. 2 to swing practice bat 10 at baseball 20 thrown or otherwise propelled as is conventional during batting practice. Entrance 14 is sized to receive baseball 20 therein, where as shown in FIGS. 3, 4 and 7 baseball 20 passes into entrance 14 and strikes guide 21. As shown in FIGS. 1, 4 and 7, guide 21 includes face 26 which is planar and has a straight or linear profile. Once baseball 20 strikes face 26 it changes course approximately 90° and proceeds along longitudinal channel 22 within ball contact section 13. Guide 21 is shown in FIGS. 4, 5 and 7 preferably with face 26 positioned at a 45° angle to redirect ball 20 on a path along channel 22 (FIG. 6) which is generally perpendicular to the thrown or propelled direction of ball 20. Ball 20 then exits egress 24 where it can be captured by preferred batter cage flexible netting 30 (seen fragmented in FIG. 2) or deflected by a screen or other similar structure so it remains close-by for easy retrieval.

As would be understood, entrance 14 is sized to accommodate the diameter of conventional baseball 20 as is channel 22, so baseball 20 moving therethrough will move unobstructedly. In FIG. 4, handle 11, shank 12 and contact section 13 are seen in axial alignment. By repetitious use of practice bat 10 user 17 can refine his swing and increase his ability to precisely strike ball 20.

By ball 20 exiting channel 22 through egress 24 a relatively small practice batting area can be maintained as struck balls can be kept in a confined space near the batting cage or netting for easy retrieval and collection.

The preferred method of using practice bat 10 consists of swinging at a thrown ball 20 by user 17 to practice his batting technique. Properly struck ball 20 passes through entrance 14 and contacts guide 21. Ball 20 then passes into longitudinal channel 22. Ball 20 then passes from channel 22 and out egress 24. As ball 20 passes through egress 24 it can be captured by a batting cage, netting 30 or the like positioned proximate thereto for rapid, convenient collection and reuse. This eliminates the need for long walks and hunting for balls which are hit long distances and possibly lost during batting practice.

The illustrations and examples provided herein are for explanatory purposes and are not intended to limit the scope of the appended claims.

I claim:

1. A practice bat for striking a moving ball comprising: a handle, a shank, said handle attached to said shank and axially aligned therewith, a ball contact section, said shank connected to said ball contact section and axially aligned therewith, said ball contact section defining a channel, an entrance and an egress, said entrance, channel and egress in fluid communication, said entrance angularly disposed to said egress wherein a ball will enter said channel through said entrance and be directed at an angle by said ball contact section to exit through said egress.

2. The practice bat of claim 1 wherein said entrance is approximately 90° from said egress.

3. The practice bat of claim 1 further comprising a guide, said guide defining a planar face, said guide positioned in said channel proximate said entrance, said face extending the diameter of said channel.

4. The practice bat of claim 3 wherein said face is angularly disposed at a 45° angle to said entrance.

5. The practice bat of claim 1 wherein said channel is sized to accommodate passage of a standard baseball.

6. The practice bat of claim 1 formed from aluminum.

7. A practice bat for striking a moving ball comprising: a ball contact section for striking a ball, said contact section defining a channel, an entrance and an egress, said entrance positioned in an approximate 90° relation to said channel, said egress in axial alignment with said channel, a guide, said guide positioned in said channel proximate said entrance, said guide defining a planar face, said face extending the diameter of said channel, wherein a ball passing through said entrance will contact said face and be directed along said channel and will exit through said egress.

8. The practice bat of claim 7 wherein said face is angularly disposed at a 45° angle to said entrance.

9. The practice bat of claim 7 wherein said entrance, channel and egress will accommodate passage of a standard baseball.

10. The method of practicing hitting a baseball whereby a bat having a channel with an entrance, a guide with a planar face, and an egress, comprises the steps of:

a) utilizing the apparatus of claim 1 or claim 7
b) swinging the bat at a ball;
c) allowing the ball to pass through the entrance into the channel;
d) striking the face of the guide with the ball to direct the ball along the channel; and
e) allowing the ball to pass from the channel and to exit through the egress.

11. The method of claim 10 wherein swinging the bat comprises the step of swinging the bat at an approaching ball.

12. The method of claim 10 wherein the step of allowing the ball to pass through the entrance comprises the step of changing the direction of the ball approximately 90° from the direction the ball entered the channel.

* * * * *